US005815989A

United States Patent [19]

Bennenk et al.

[11] Patent Number: 5,815,989

[45] Date of Patent: Oct. 6, 1998

[54] CANTILEVERED ROOF CONSTRUCTION

[76] Inventors: Hendrik Willem Bennenk, Elger 13, NL-1141 CC, Monnickendam; Johannis Istha, Kernkampplantsoen 4, NL-3571 PJ, Utrecht; Robert Van Der Leij, De Gouwe 31, NL-1121 GC, Landsmeer, all of Netherlands

[21] Appl. No.: 669,427

[22] PCT Filed: Jan. 9, 1995

[86] PCT No.: PCT/NL95/00012

§ 371 Date: Nov. 12, 1996

§ 102(e) Date: Nov. 12, 1996

[87] PCT Pub. No.: WO95/18897

PCT Pub. Date: Jul. 13, 1995

[30] Foreign Application Priority Data

Jan. 7, 1994 [NL] Netherlands ..... 9400028

[51] Int. Cl.[6] ..... E04B 7/20; E04D 3/35; E04C 2/32; E04C 2/36

[52] U.S. Cl. ..... 52/80.1; 52/86; 52/309.7; 52/309.11; 52/309.14; 52/309.16; 52/574; 52/588.1; 52/590.2; 52/592.2; 52/787.1; 52/794.1; 52/798.1; 52/801.11

[58] Field of Search ..... 52/787.1, 787.11, 52/792.1, 794.1, 798.1, 801.1, 801.11, 309.2, 309.7, 309.9, 309.11, 309.14, 309.16, 783.11, 588.1, 590.2, 591.3, 591.4, 591.5, 592.1, 592.2, 792.11, 589.11, 80.1, 81.4, 86, 87, 574

[56] References Cited

U.S. PATENT DOCUMENTS

| | | | |
|---|---|---|---|
| 2,616,149 | 11/1952 | Waller | 52/86 X |
| 3,062,337 | 11/1962 | Zittle . | |
| 3,089,281 | 5/1963 | Borges | 52/86 |
| 3,313,073 | 4/1967 | Mathews | 52/787.11 X |
| 3,330,080 | 7/1967 | Grieb et al. . | |
| 3,331,173 | 7/1967 | Elsner | 52/309.11 |
| 3,367,076 | 2/1968 | O'Brien | 52/309.11 X |
| 3,381,432 | 5/1968 | Brandwein | 52/86 X |
| 3,732,138 | 5/1973 | Almog . | |
| 3,785,103 | 1/1974 | Turner | 52/309.11 |
| 3,786,611 | 1/1974 | Brown et al. | 52/309.2 |
| 4,373,312 | 2/1983 | Kim | 52/309.9 |
| 4,395,853 | 8/1983 | Lemaitre | 52/309.11 X |
| 4,575,981 | 3/1986 | Porter | 52/309.9 |
| 4,907,383 | 3/1990 | Winter, IV | 52/86 |
| 5,274,979 | 1/1994 | Tsai | 52/588.1 |
| 5,424,118 | 6/1995 | McLaughlin | 52/588.1 X |

FOREIGN PATENT DOCUMENTS

| | | | |
|---|---|---|---|
| 507536 | 12/1951 | Belgium | 52/574 |
| 84314 | 1/1965 | France . | |
| 2698394 | 5/1994 | France | 52/798.1 |
| 30969 | 3/1966 | Germany | 52/80.1 |
| 2 600 792 | 7/1977 | Germany . | |
| 81 03038 | 1/1983 | Netherlands . | |
| 958610 | 9/1982 | U.S.S.R. | 52/798.1 |
| 1735528 | 5/1992 | U.S.S.R. | 52/80.1 |
| 1 225 152 | 3/1971 | United Kingdom . | |

*Primary Examiner*—Carl D. Friedman
*Assistant Examiner*—Laura A. Callo
*Attorney, Agent, or Firm*—Young & Thompson

[57] ABSTRACT

A roof construction with a number of roof elements coupled together to form an up and down, essentially corrugated construction. The connection point of the roof elements is in the region of the neutral line. In this way particularly large spans can be achieved without special measures.

20 Claims, 1 Drawing Sheet

CANTILEVERED ROOF CONSTRUCTION

Figure 1:
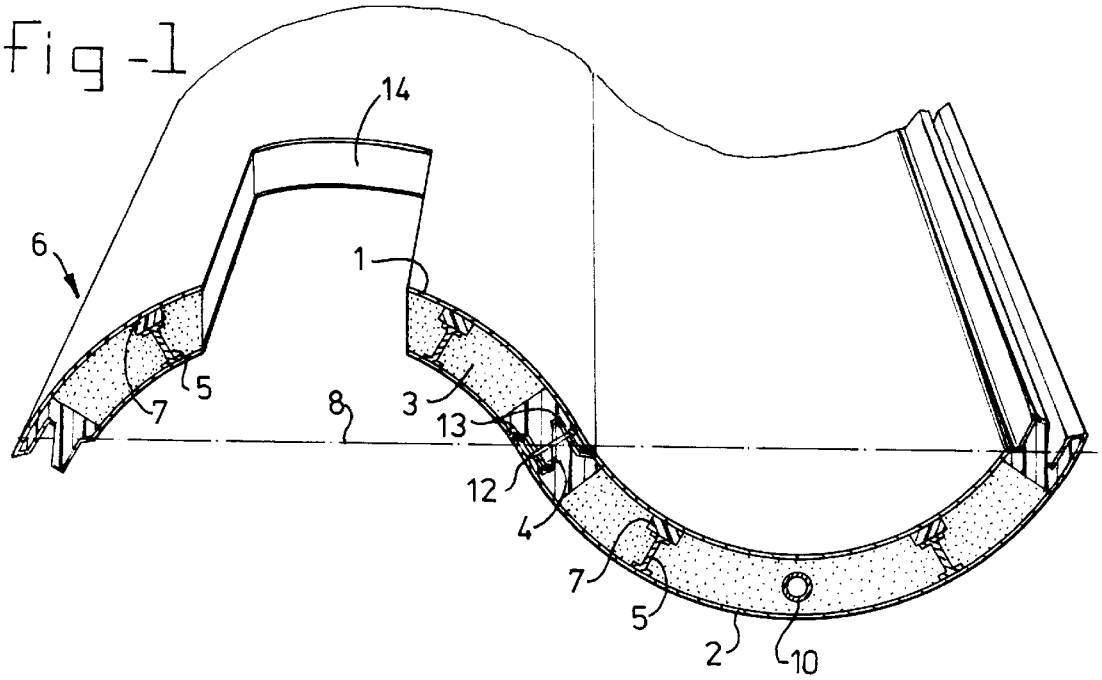

The present invention relates to a cantilevered roof construction.

Such a construction is known from British Patent Specification 1,225,152, which describes a roof section consisting of two metal outer and inner plates respectively which lie at a distance from each other and between which a foam material is disposed. These sections or elements are coupled to each other. It is stated that such a construction is supported at regular intervals at right angles to the lengthwise direction by supporting walls, beams or the like.

The disadvantage of such roof elements is that the free length to be spanned is normally about 6 meters, and is a maximum of 8 meters. This means that through the presence of walls or horizontal beams supporting the roof elements, which walls or beams are in turn supported by vertical columns, only a limited free floor surface in the part of the building below the roof construction can be obtained.

This is a disadvantage in the case of, for example, sports halls, stores and buildings in which an open layout is of great importance.

The object of the present invention is to improve this construction so that greater support-free covered areas with an open layout are obtained.

It has been found that if large spans are achieved with the roof elements according to British Patent Specification 1,225,152, permanent bending stresses, which cannot be absorbed by the foam material disposed between the outer and inner skin of roof elements, occur. It has been found that such a foam material can absorb only brief pressure forces, and as soon as shearing forces or other forces give rise to forces resulting in a tensile force the foam material fails and the roof element collapses. Besides, the foam exhibits strong creep tendencies, with the result that lengthy pressure loading is not acceptable. In the case of the construction according to the British patent the foam is thus used only as an insulating and filling material. Through the presence of the flanged edges on the inner and outer skin, it can always be ensured that the distance between outer skin and inner skin is constant, so that the strength of the 'box construction' formed by the outer and inner skin does not decrease.

For the invention it is essential for roof elements to follow each other in "ridge" and "trough" formation. Although this is also disclosed in British Patent Specification 1,225,152, this sequence does not appear to contribute to the strength required for producing greater spans. Moreover, the absence of reinforcing couplings and connecting materials between the various elements means that this cannot be expected, or intermediate supports are necessary.

U.S. Pat. No. 3,732,138 discloses a flat panel construction. The flat character means that it is simply impossible to obtain the strength which can be achieved by the present invention, so that a greater number of supports is always necessary. If used as a roof construction, roof elements according to U.S. Pat. No. 3,732,138 can be used only as a sound-insulating and sealing construction, which must be supported on yet a further construction. Rigidity and strength are reduced through the indirect connection of the body to the top plate by way of the foam. The absence of a foam layer extending over the full thickness of the section means that the strength which can be achieved with the roof elements according to the invention cannot be obtained.

With the construction according to the present invention it is possible to achieve free spans of at least 15 meters, and up to as much as 30 meters and more. It will be understood that this makes it possible to achieve buildings which, on the one hand, are cheap and, on the other hand, offer a particularly large range of potential uses, due to the absence of supports. The connecting sections and the edge sections of the roof elements will generally be made of metal or plastic material. The connecting sections are preferably provided in some way with insulation, so that no direct heat conduction between the outer skin and the inner skin of the sandwich construction is possible, and the risk of thermal bridges is avoided. It is possible to provide the edge sections with means which prevent shifting relative to each other after fitting. For example, adjacent edge sections can be provided with complementary teeth.

It is possible to fit conduit means in the space between the inner skin and the outer skin. It is also possible to provide openings in the sandwich construction for the fitting of hatches, windows etc. Moreover, it is possible to fit fastenings on the above-described connecting sections, for articles to be suspended from the roof elements. Separate connecting sections can also be fitted for this purpose.

According to an advantageous embodiment of the invention, the longitudinal edges of adjacent roof elements are profiled and provided with fastening means for the purpose of making these elements interact constructionally. These fastening means can act in order to clamp parts of adjacent roof elements against each other. Moreover, it is possible for the fastening means to be designed to make adjacent roof elements interact at the fastening point in the direction essentially parallel to the contact line on both roof elements.

A broad range of embodiments must be understood by the term "an up and down, essentially arched construction". For example, it is possible to make at least one of said arched parts trapezoidal. Other variants between a trapezium shape and a pure arch shape are conceivable.

The invention will be explained in greater detail below with reference to an exemplary embodiment shown in the drawing.

Figure 2:
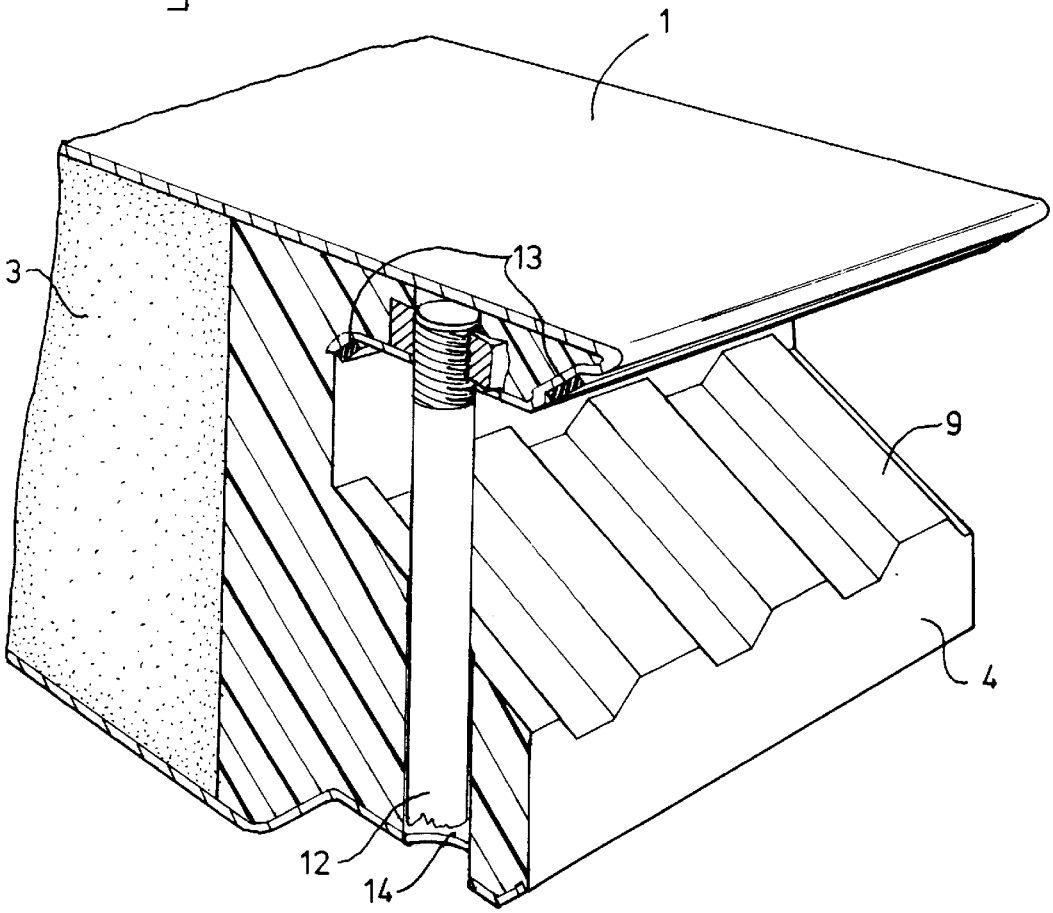

FIG. 1 shows two adjacent roof elements in cross-section, combined to form the roof construction according to the invention; and FIG. 2 shows a detail of the edge section of an element in perspective view.

The roof elements are indicated by 6 in FIG. 1. In the present exemplary embodiment they are of essentially identical design, but it must be understood that this is not necessary. In a manner which is not shown in any further detail, the roof elements together forming the cantilevered roof construction are placed at the short sides on a support (not shown). In order to give an idea and by way of example, it is stated here that each roof element has a working breadth of about 2.40 m, a length of approximately 32 m and a total wall thickness from about 75 mm, while the height of a "corrugation" can be about 1.40 m.

Each roof element consists of an outer skin 1 and an inner skin 2. Of course, the fact is that if essentially identical elements are used and they are used alternately inverted as in the embodiment shown, the outer and inner skin will always be inverted, and the connecting sections 5 and the insulation 7 can also be used inverted.

A foam layer 3, which near the free end passes into a plastic edge section 4, is fitted between the outer and inner skin. This foam layer, combined with plastic section 4, provides a constructional connection between the inner and outer skin, prevents wrinkling or buckling of the outer skin, and acts as a spacer and gives the construction the required insulating properties. Connecting sections 5 are present, in order to give the sandwich construction thus obtained sufficient rigidity. Fitting of the connecting sections, which operate in the lengthwise direction, prevents the outer skin 1 and inner skin 2 from being able to deform relative to each other. These connecting sections are of great importance for the bearing power of the roof construction. In order to avoid thermal bridges between the inner and outer skin through the connecting sections, insulation 7 is incorporated at least at one side of said connecting sections 5. The roof elements are coupled together by the edge sections 4.

This is shown in greater detail in FIG. 2. Each edge section comprises a number of teeth 9 which are spaced apart and are fitted in such a way that when two adjacent roof elements are slid into each other movement in a direction at right angles to the longitudinal axis of the teeth is not possible. Strips 13 of plastic material are incorporated in order to avoid thermal bridges. The design of the edge sections 4 will provide a first seal against wind and water. Further sealing is provided by the strips 13 in order to prevent wind and moisture from entering as far as possible. In the left part of FIG. 1 fastening means 12 are indicated as an example for pressing the panels against each other. These fastening means are passed through an opening 14 in edge section 4. The shearing forces acting between the two panels are absorbed by contact pressure, mutual friction, and by direct force transmission by way of the fastening means and teeth 9. The neutral line is indicated by 8, and it appears that the connection between two adjacent roof elements is provided precisely at the point of the neutral line.

Instead of the fastening means 12 shown here, which are inserted from one side and do not come into contact with the environment at the other side, fastening means which pull the adjacent roof elements towards each other in the direction parallel to the contact line at the connecting point, i.e. in the direction at right angles to the direction of the fastening means 12 in the drawing, can also be fitted. Moreover, fastening by gluing or sliding or snapping adjacent roof elements into each other is conceivable. Of course, it is possible for the mutual fastening to lie slightly outside this neutral line, and a deviation of 30% of the total height of the roof construction upwards and downwards lies within the scope of the present invention. Making the connection at this point ensures that shearing forces are of necessity essentially absorbed.

All parts of the roof elements which can be adversely affected by the environment can be provided with a protective covering.

Conduits 10 can be fitted in the foam layer 3. Said conduits can extend in all directions and are suitable for multiple purposes, such as water, energy and communications. Moreover, it is possible to make the openings indicated diagrammatically by 14 in the roof elements. Said openings can be used for hatches, windows and the like. The construction selected means that it is not necessary to provide additional reinforcements in order to achieve such openings.

Parts can be fixed from the inside to the connecting sections 5. It is also possible to fit separate sections for this purpose. The foam of the foam layer can be any foam which is known in the prior art, and as an example comprises polyurethane foam which is injected into the space between the outer skin and inner skin or is placed therein by gluing. Instead of the above-described symmetrical solution for the roof elements, it is quite possible to use different roof elements. This can be important, for example, for the materials used for the inner and outer skin, but it is also conceivable for the "trough" to be a different shape from the "ridge". One of these parts can be, for example, trapezoidal in shape, or can be any other shape lying between trapezoidal and corrugated.

It has been found that with a roof construction according to the invention it is not necessary to fit intermediate external supporting constructions, while such strength and rigidity are still achieved that all requirements laid down by standards and regulations can be met, e.g. safe to walk on, snow pressure etc. Although not shown here, it goes without saying that a suitable end section is fitted at the end faces.

It must be understood that only one exemplary embodiment is given in the above and that numerous modifications are possible.

For example, it is possible to increase the height of the corrugated construction considerably and also the working length of each of the roof elements. This makes greater spans possible, the limits of which are determined by the transport between the place of manufacture and the building site.

These and other modifications are considered to lie within the scope of the appended claims.

We claim:

1. A roof construction, comprising:

at least one corrugated construction having two identical longitudinally extended elements, namely a top one of said elements forming a ridge and a bottom one of said elements forming a trough, that are directly connected to each other at their respective longitudinal edges near a neutral line of said corrugated construction, wherein each of said top and bottom elements comprises a sandwich construction with an outer skin, a filling, an inner skin, and reinforcing connections at longitudinal edges that connect said inner skin and said outer skin to each other, and wherein said corrugated construction is at least fifteen meters long and is substantially rigid when supported only at its longitudinal ends.

2. The roof construction of claim 1, wherein said reinforcing connection comprises insulation.

3. The roof construction of claim 1, further comprising a longitudinally aligned conduit between said inner skin and said outer skin.

4. The roof construction of claim 1, further comprising a fastener connecting the respective longitudinal edges of said two elements.

5. The roof construction of claim 4, wherein said fastener is perpendicular to said inner skin.

6. The roof construction of claim 5, wherein said fastener extends through said inner skin and into said respective longitudinal edges without piercing said outer skin.

7. The roof construction of claim 1, wherein each of said respective longitudinal edges comprise sealing means for preventing fluid communication between said inner and outer skins through said respective longitudinal edges.

8. The roof construction of claim 1, wherein each of said reinforcing connections comprise a tongue and a complementary laterally extended groove in said longitudinal edges and a reinforcing, thermally insulating material between said inner and outer skins that extends laterally to a distance greater than said groove.

9. The roof construction of claim 8, wherein said tongue and said groove each comprise laterally extended and complementary ridges and valleys.

10. The roof construction of claim 8, further comprising a fastener connecting the respective longitudinal edges of said two elements that extends through said inner skin, said tongue, and said groove.

11. The roof construction of claim 10, wherein said fastener does not pierce said outer skin.

12. The roof construction of claim 1, wherein said filling comprises a plastic foam.

13. The roof construction of claim 1, further comprising a closable opening through one of said two elements.

14. A roof construction, comprising:

at least one corrugated construction having two identical longitudinally extended elements, namely a top one of said elements forming a ridge and a bottom one of said elements forming a trough, that are directly connected to each other at their respective longitudinal edges near a neutral line of said corrugated construction, wherein each of said top and bottom elements comprises a sandwich construction with an outer skin, a filling, an inner skin, and tongue and groove reinforcing connections at longitudinal edges that connect said inner skin and said outer skin to each other, said reinforcing connections each comprising a reinforcing, thermally insulating material between said inner and outer skins that extends laterally to a distance greater than said groove.

15. The roof construction of claim 14, further comprising a fastener connecting the respective longitudinal edges of said two elements that extends perpendicularly through said inner skin, and through said tongue and said groove of respective ones of said longitudinal edges of said two elements.

16. The roof construction of claim 15, wherein said reinforcing connections of said top element each comprise a flap that is a lateral extension of said outer skin, said flap extending over said tongue of said reinforcing connection of said bottom element.

17. The roof construction of claim 16, wherein an end of said fastener is attached to said flap.

18. The roof construction of claim 14, wherein said tongue and groove comprise laterally extended and complementary ridges and valleys.

19. The roof construction of claim 14, wherein said corrugated construction is at least fifteen meters long and is substantially rigid when supported only at its longitudinal ends.

20. The roof construction of claim 14, wherein said corrugated construction has a vertical cross sectional shape that is sinusoidal.

* * * * *